United States Patent [19]

Liu et al.

[11] Patent Number: 5,017,158

[45] Date of Patent: May 21, 1991

[54] STRUCTURE OF RECEPTACLE FOR ELECTRIC CONNECTOR WITH SELF-LOCKING AND ELECTRIC SHIELD MECHANISM

[75] Inventors: Yun-Yu Liu; Hsiao-Lei Shih, both of Taipei Hsien, Taiwan

[73] Assignee: Pan-International Industrial Corp., Taipei Hsien, Taiwan

[21] Appl. No.: 517,753

[22] Filed: May 2, 1990

[51] Int. Cl.[5] ..... H01R 13/648; H01R 19/00

[52] U.S. Cl. ..... 439/609; 439/746

[58] Field of Search ..... 439/607, 609, 610, 581, 439/63, 92, 582, 668, 101, 105, 108, 95, 675, 78, 79, 746

[56] References Cited

U.S. PATENT DOCUMENTS

| | | | |
|---|---|---|---|
| 4,428,639 | 1/1984 | Hillis | 439/609 |
| 4,598,961 | 7/1986 | Cohen | 439/581 X |
| 4,743,205 | 5/1988 | Mitani et al. | 439/843 X |
| 4,842,555 | 1/1989 | Cosmos et al. | 439/609 |
| 4,938,714 | 7/1990 | Kawai et al. | 439/609 X |

OTHER PUBLICATIONS

Commercial Mini Sockets and Connectors, 19 sheets.

*Primary Examiner*—David L. Pirlot

*Assistant Examiner*—Julie R. Daulton

*Attorney, Agent, or Firm*—Fleit, Jacobson, Cohn, Price, Holman & Stern

[57] ABSTRACT

A receptacle for computer mother board connectors with a self-locking and electric shielding mechanism, which includes a rubber core (1) incorporated with a metal ring (2) and received in a metal casing (3). The rubber core (1) is unitarily made of rubber material through a shape molding process, and has a circular slot (13) on its front end, or top, for the insertion therein of the metal ring (2), two recessed holes (14) and two fastening holes (15) at both opposite sides for securing the metal ring and the metal casing to provide good electric shielding. The metal ring (2) has top clamping member (21) and inner projections (22) to match with corresponding convex portions (312) around the circumference of a hole (311) on the front wall (31) of the metal casing (3) permitting the clamping members and the inner projections to firmly retain the copper fastening tube of the plug which is inserted therein and permitting the clamping members to firmly contact the convex portions of the metal casing to form a grounded circuit. The metal ring also comprises a semi-circular hole (20) for the fastening therein of a retainer portion on the copper fastening tube of the matching plug so that the plug is firmly secured thereto.

19 Claims, 10 Drawing Sheets

STRUCTURE OF RECEPTACLE FOR ELECTRIC CONNECTOR WITH SELF-LOCKING AND ELECTRIC SHIELD MECHANISM

BACKGROUND OF THE INVENTION

The present invention relates to receptacles for electric connectors which are used in mother boards in the computer mainframe, and more particularly to a receptacle for electric connectors which includes a rubber core coupled with a metal ring and received in a metal casing and having a self-locking and electric shielding mechanism to protect the connectors against interference of electromagnetic waves.

Regular connectors for use on a computer mother board are generally comprised of a receptacle incorporated with a plug. The receptacle of the conventional connectors for computer mother boards includes a rubber core received in a metal casing. The rubber core is generally comprised of two parts, one for receiving a copper ring and terminals, and the other for fastening. One disadvantage of this type of receptacle is that the rubber core is more expensive to manufacture (it requires two separate molds for shape molding) and its structure is not reinforced and tends to deform. Because a notch must be made on the rubber core for the ground terminal of the copper ring to pass, the receptacle may be deformed during production. Another disadvantage of this type of receptacle is that the metal casing can not efficiently shield the rubber core against interference of external electromagnetic waves because it can only shield the top side and the two lateral sides of the rubber core. Further, when the copper fastening tube of a plug is inserted, the copper fastening tube of such a plug and the copper ring and the metal casing of the receptacle must form a grounded circuit. Because the copper ring and the metal casing of the this type of receptacle are connected by mechanical means (for example, rivet or welding connection) and the connection between the copper ring and the copper fastening tube of the plug is made through a contact connection, the connection of the plug with the receptacle is not firmly secured. Therefore, the receptacle can not provide high stability and may affect normal operation of a computer.

There is another type of receptacle for connectors used in computer mother boards, which includes a unitary rubber core made through a shape molding process, and a metal casing covering over the front end, the top and the two lateral sides of the rubber core to shield the rubber core against interference of external electromagnetic waves. In this type of receptacle, the metal casing has a hole on its front wall for the insertion therethrough of the copper fastening tube of a plug, and a plurality of unitary conductive strips extending inward from the circumference of the hole. During assembly, the conductive strips are inserted in a circular slot of the rubber core [1] and the copper fastening tube of the plug is simultaneously inserted in such circular slot of the rubber core so that the copper fastening tube of the plug and the metal casing form a grounded circuit. The electric shielding effect of this type of receptacle is still not satisfactory. Further, the outward tension force of the metal casing must be overcome during assembly.

SUMMARY OF THE INVENTION

One object of the present invention is to provide a receptacle for electric connectors, which includes a unitary rubber core made of rubber material through a shape molding process, having a ring slot on its front end for the fastening therein of the copper fastening tube of a plug, recessed holes and fastening holes on both sides for the fastening therein of the clamping members of a metal ring so as to incorporate with a metal casing to provide good electric shielding effect.

Another object of the present invention is to provide a receptacle for electric connectors, which includes a metal ring having elastic projections extending from its inner wall surface for pressing upon the copper fastening tube of the plug which is inserted therein so as to reinforce the stability of the connection.

Still another object of the present invention is to provide a receptacle for electric connectors, which includes a metal casing having a top wall formed of two wing portions extending from its two side walls, which two wing portions are connected together by means of the incorporation of a tongue with a groove to overcome the outward tension of the metal casing during its shape forming process through a bending operation.

Still another object of the present invention is to provide a receptacle for electric connectors, which includes a metal casing having a plurality of arch-shaped convex portions around the circumference of a hole on its front wall to match with a plurality of clamping members of a metal ring permitting the clamping members of such a metal ring to be forced by the copper fastening tube of the plug, which is inserted therein, to firmly contact the metal casing to form a grounded circuit.

Still another object of the present invention is to provide a receptacle for electric connectors, which includes a metal casing having a unitary fastening plate extending upward from the top of its front wall, which fastening plate has a bolt hole thereon for the fastening therein of a screw means to secure the metal casing of the receptacle to a computer mainframe so as to stabilize the connections thereto of a corresponding plug.

BRIEF DESCRIPTION OF THE DRAWINGS

The invention will now be described in detail with reference to the accompanying drawings wherein.

DETAILED DESCRIPTION OF THE PREFERRED EMBODIMENTS

A receptacle for cable connectors with a self-locking and electric shielding mechanism in accordance with the present invention is generally comprised of a rubber core retained in a metal ring and received in a casing.

Figure 1:
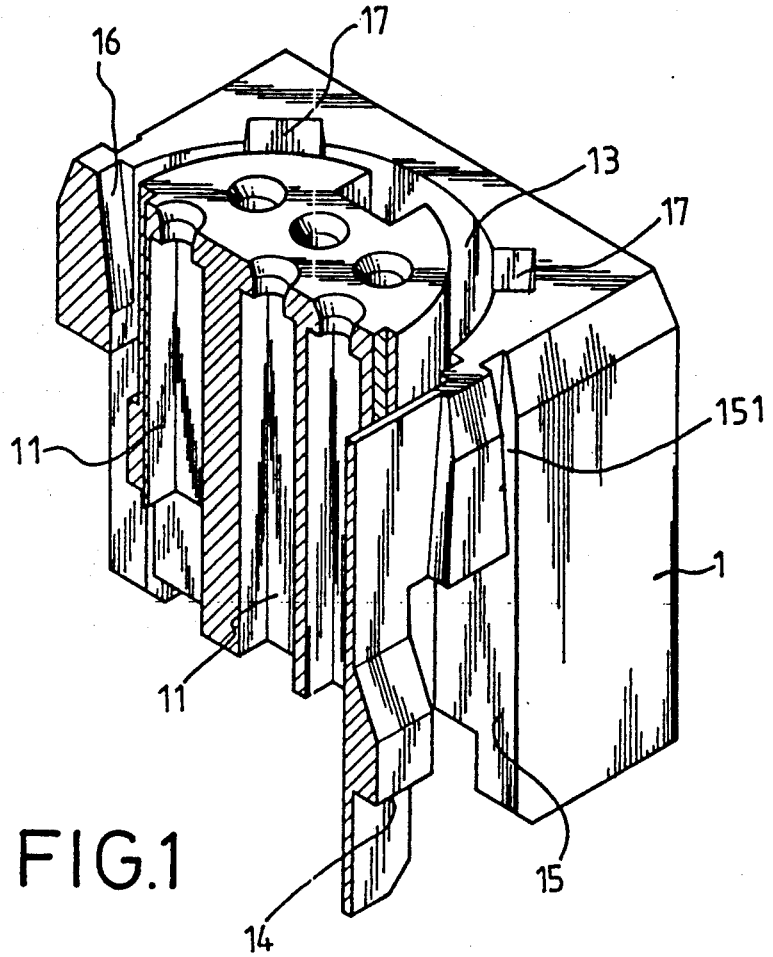
FIG. 1 is a perspective and cross sectional view of a rubber core according to the present invention.
Figure 2:
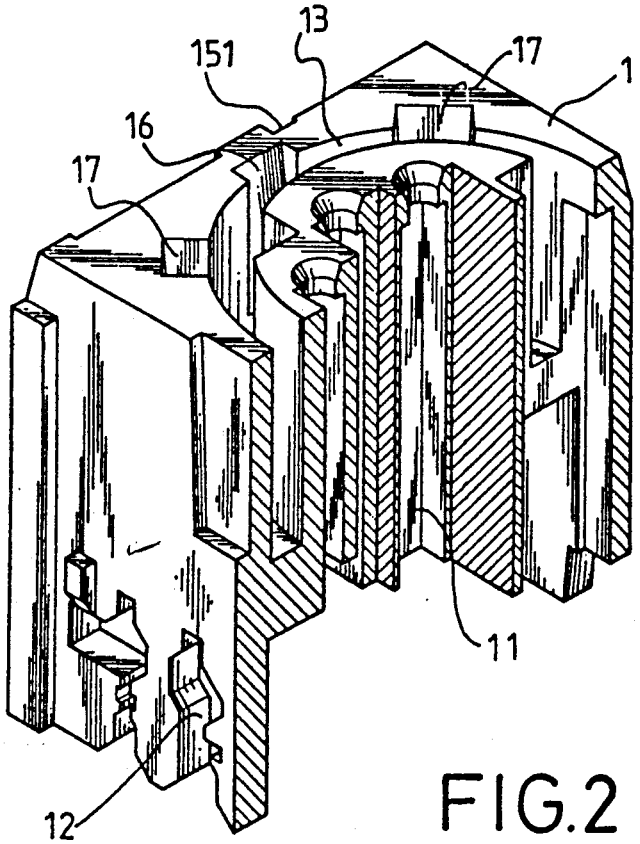
FIG. 2 is another perspective and cross sectional view of the rubber core of FIG. 1.

Referring to FIG. 1, therein is a rubber core 1 of the present invention. The rubber core 1 is integrally made through a shape molding process, comprising a circular slot 13 on the top, a plurality of pin holes 11 therethrough for the insertion of the pins of a corresponding plug, two opposite fastening holes 15 and recessed holes 14 at both sides, which fastening holes 15 comprise each a tapered guide slot 151 extending upward to the top.

Figure 3:
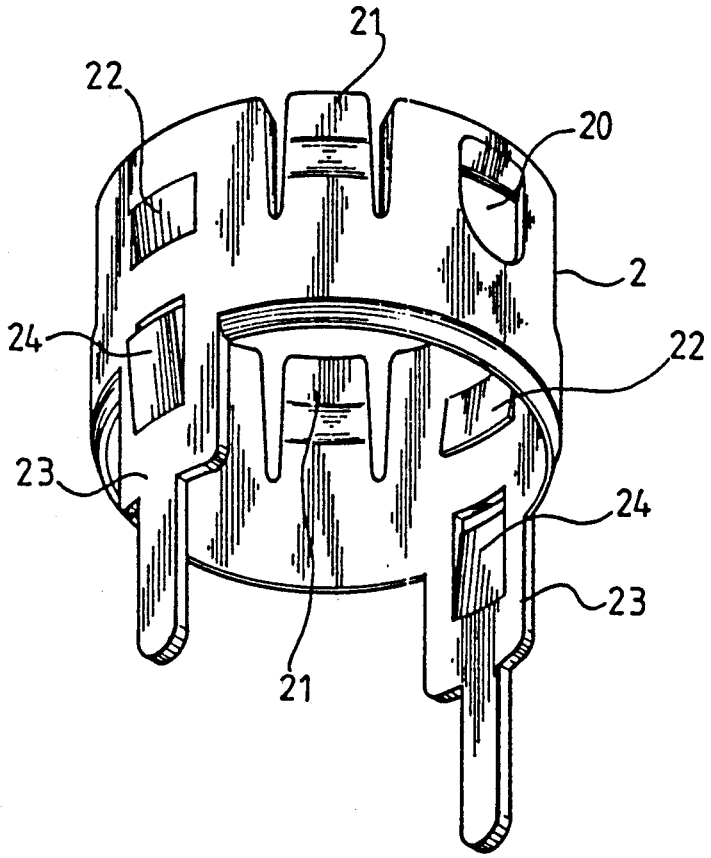
FIG. 3 is a perspective view of a metal ring according to the present invention.

FIG. 3 illustrates a metal ring 2 of the present invention. The metal ring 2 comprises a plurality of unitary, elastic, vertical clamping members 21, a semi-circular side hole 20 into which a retainer portion on a fastening tube of a plug can be inserted, a plurality of elastic projections 22 from its inner wall surface, two unitary, opposite retainer plates 24, and two opposite positioning pins 23.

Figure 4:
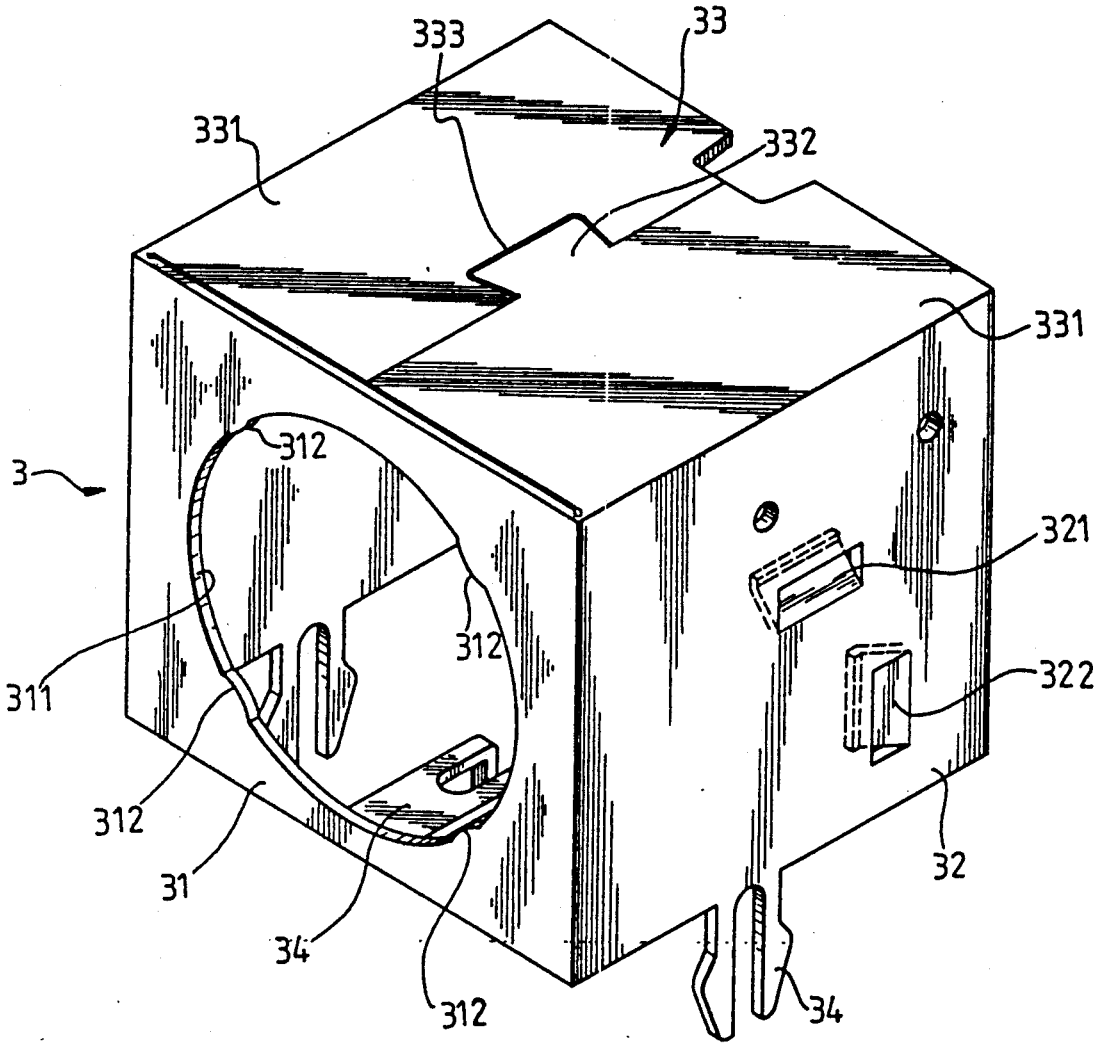
FIG. 4 is a perspective view of a metal casing according to the present invention.

FIG. 4 illustrates a metal casing 3 of the present invention. The metal casing 3 comprises a front wall 31 two side walls 32 and a top wall 33. The front wall 31 includes a hole 311 having a plurality of arch-shaped convex portions 312 around its circumference. The two side walls 32 comprise each two clamping members 321 and 322 respectively projecting inward from its inner wall surface. The top wall 33 is formed of two unitary wing portions 331 extending from the two side walls 32, which wing portions (331) are respectively connected together by means of the incorporation of a tongue 332 with a groove 333 thereof. In the present embodiment, the tongue 332 and groove 333 are in dovetailed shape. As alternate forms of the present invention, the tongue 332 and the groove 333 of the wing portions 331 can be of circular, polygonal or any shape permitting the two wing portions 331 of the two side walls 32 to be firmly retained with each other. The front wall 31 and the two side walls 32 comprise each a ground connecting plate 34 for fastening in a mother board.

Figure 5:
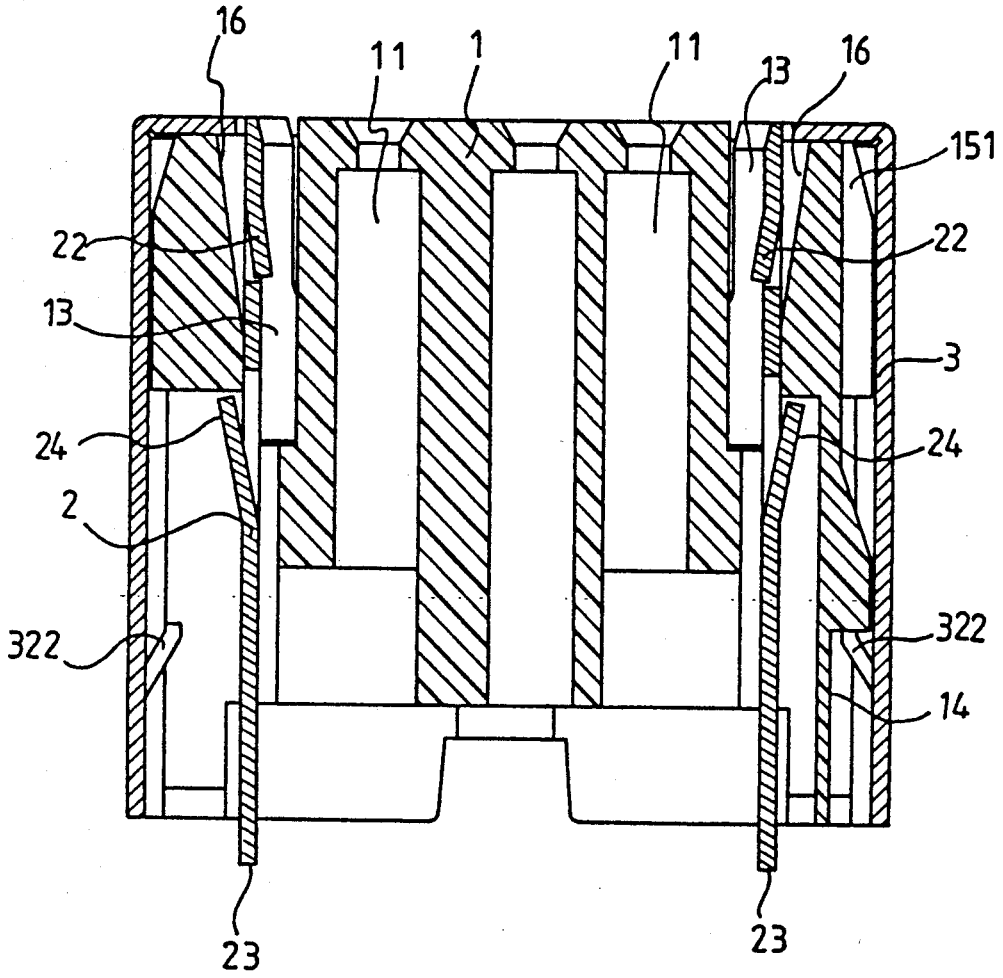
FIG. 5 is a cross sectional assembly view of a receptacle according to the present invention.
Figure 6:
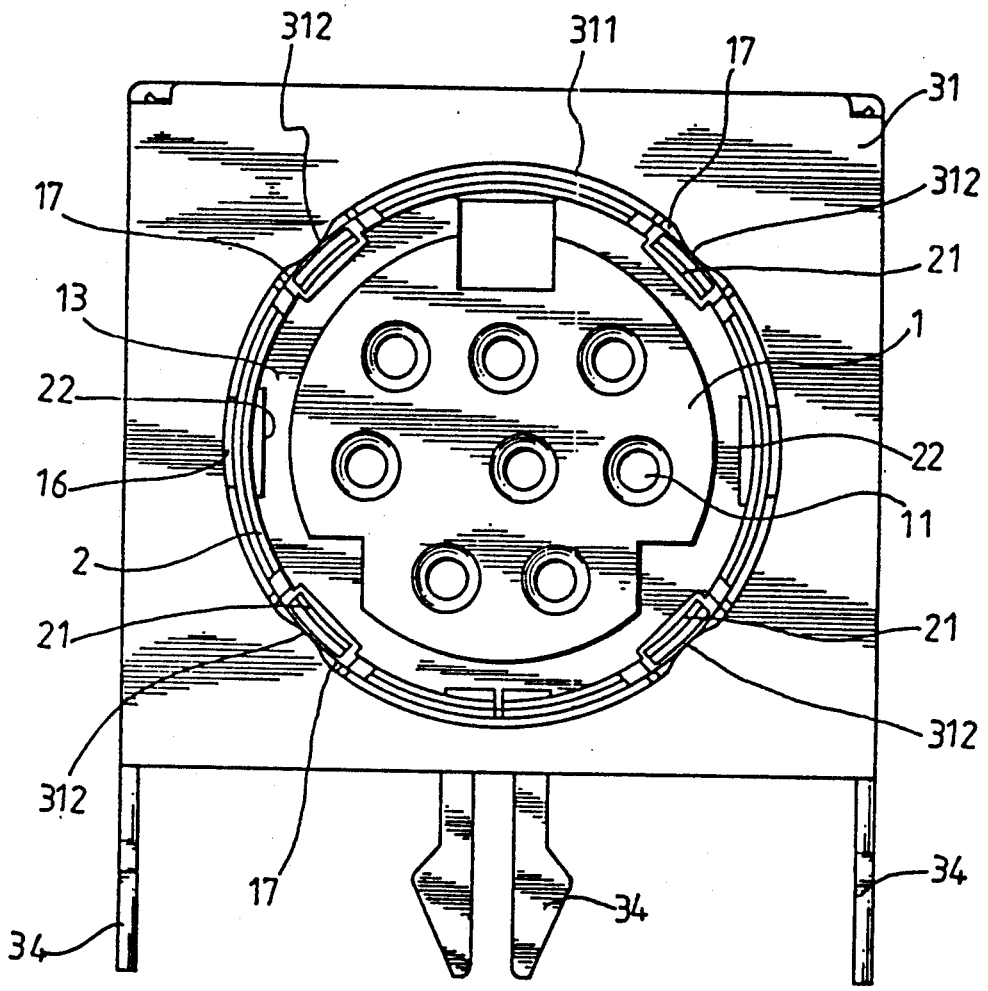
FIG. 6 is a front elevational view of the receptacle of FIG. 5.
Figure 7:
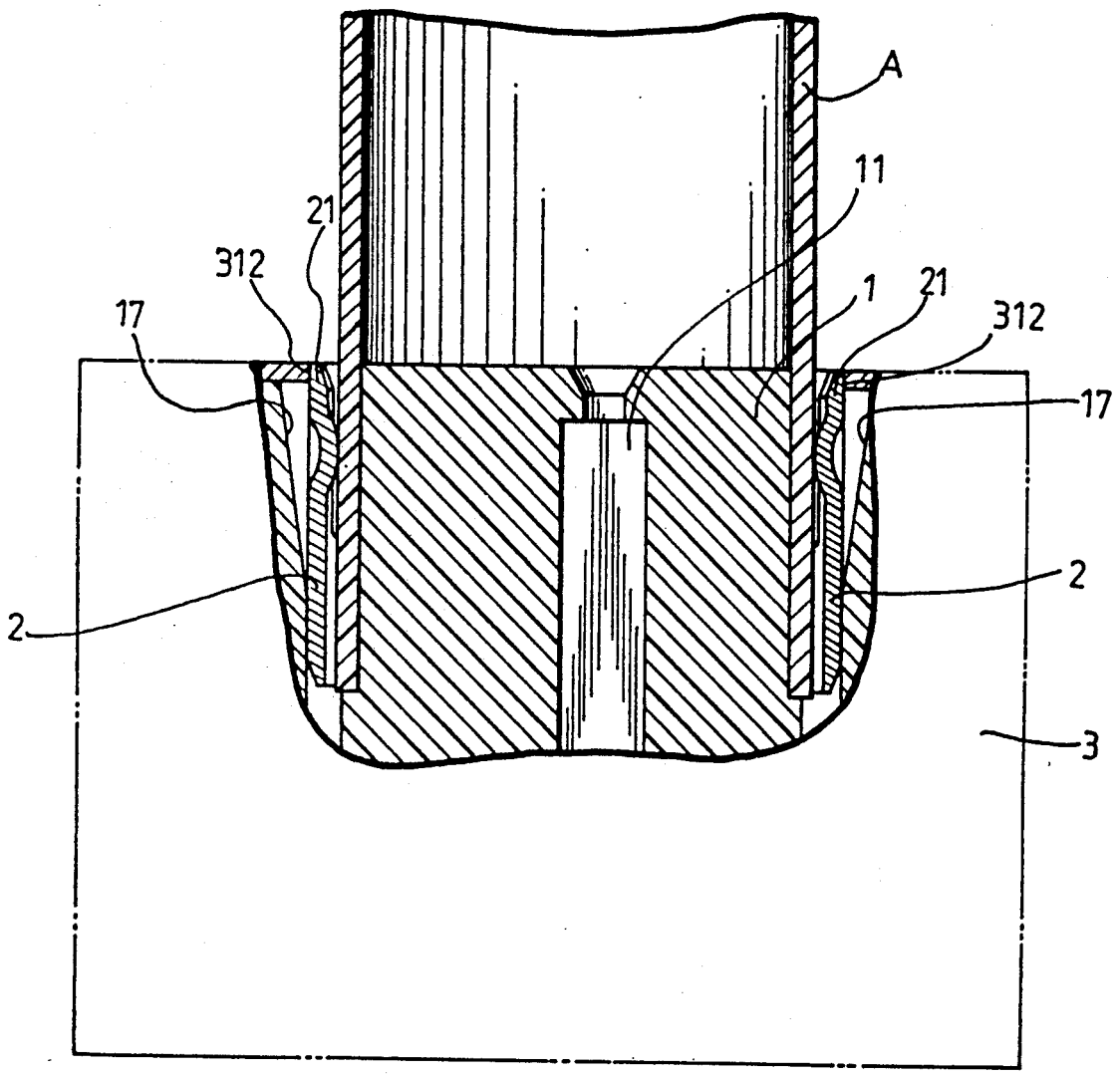
FIG. 7 is a schematic cross-sectional view illustrating the fastening of a fastening tube in the receptacle of the present invention.

During assembly, the positioning pins 23 of the metal ring 2 are inserted in corresponding retaining holes 16 on the rubber core 1 with the retainer plates 24 respectively set in the bottom of the retaining holes 16 permitting the metal ring 2 to be firmly retained in the circular slot 13, as illustrated in FIG. 5, to electrically shield the rubber core 1. The metal casing 3 is externally connected to the rubber core 1 with its upper clamping members 321 inserted through the tapered guide slots 151 into the fastening holes 15, with its lower clamping members 322 fastened in the recessed holes 14 to shield the rubber core 1, permitting the hole 311 of its front wall 31 to closely contact the outer edge of the metal ring 2 and permitting the arch-shaped convex portions 312 of the hole 311 of its front wall 31 to force the elastic clamping members 21 of the metal ring 2 in respective recessed slots 17 in the rubber core 1 (see FIG. 6). When the copper fastening tube (A) of a plug is inserted in the metal ring 2, the clamping members 21 of the metal ring 2 are forced to clamp up the copper fastening tube (A) and the elastic projections 22 are simultaneously forced to press upon the copper fastening tube (A) so as to firmly retain the fastening tube (A) of such a plug in the metal ring 2. Simultaneously, the clamping members 21 of the metal ring 2 are forced by the copper fastening tube (A) to contact the arch-shaped convex portions 312 of the metal casing 3 to form an earthed circuit. The design of the recessed slots 17 of the rubber core (1) permits the elastic clamping members 21 to incorporate with the metal casing 3 to form a grounded circuit and simultaneously to clamp the fastening tube (A) of the connected plug (see FIG. 7).

Figure 8:
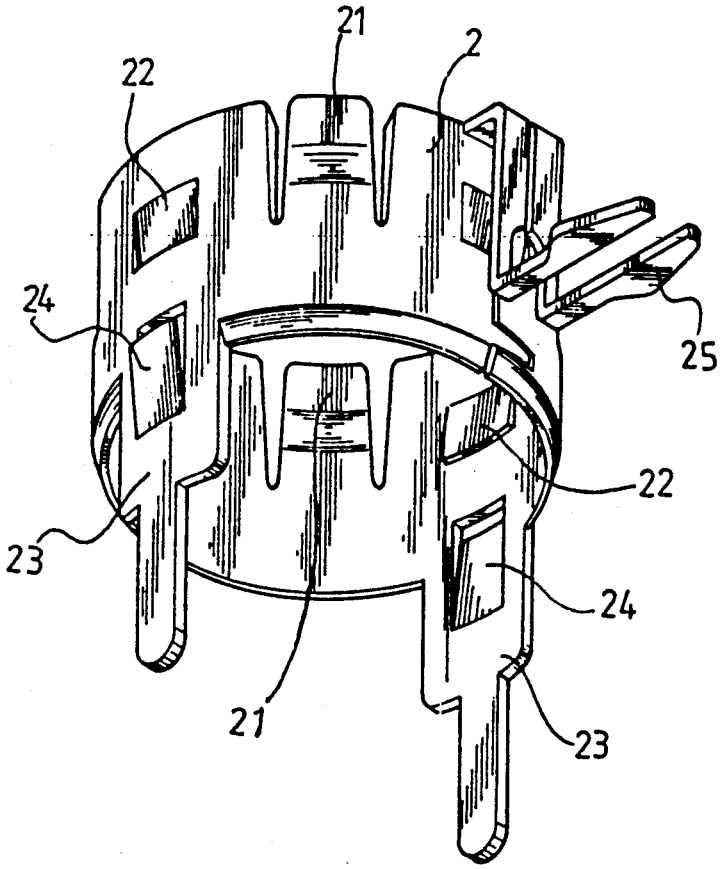
FIG. 8 is a perspective view which illustrates an alternate form of the metal ring of the present invention.
Figure 9:
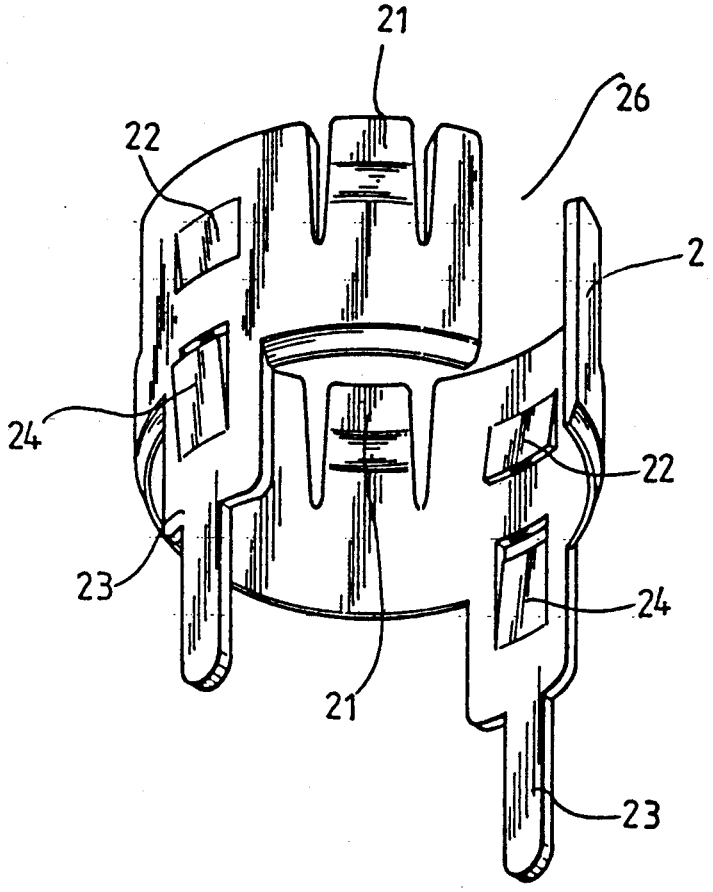
FIG. 9 is a view similar to FIG. 8 which illustrates still another alternate form of the metal ring of the present invention.
Figure 10:
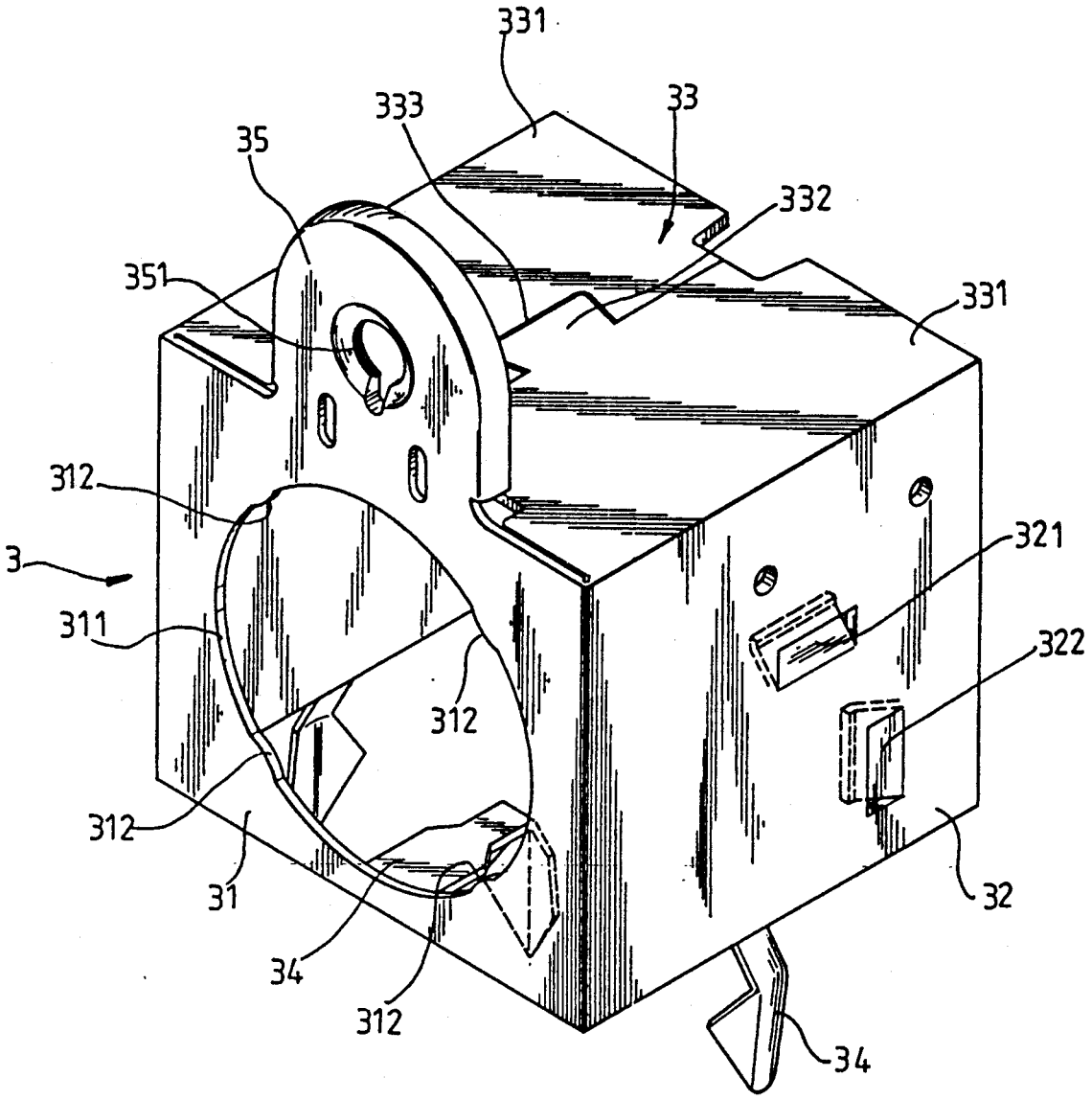
FIG. 10 is a view similar to FIG. 4 which illustrates an alternate form of the metal casing of the present invention.
Figure 11:
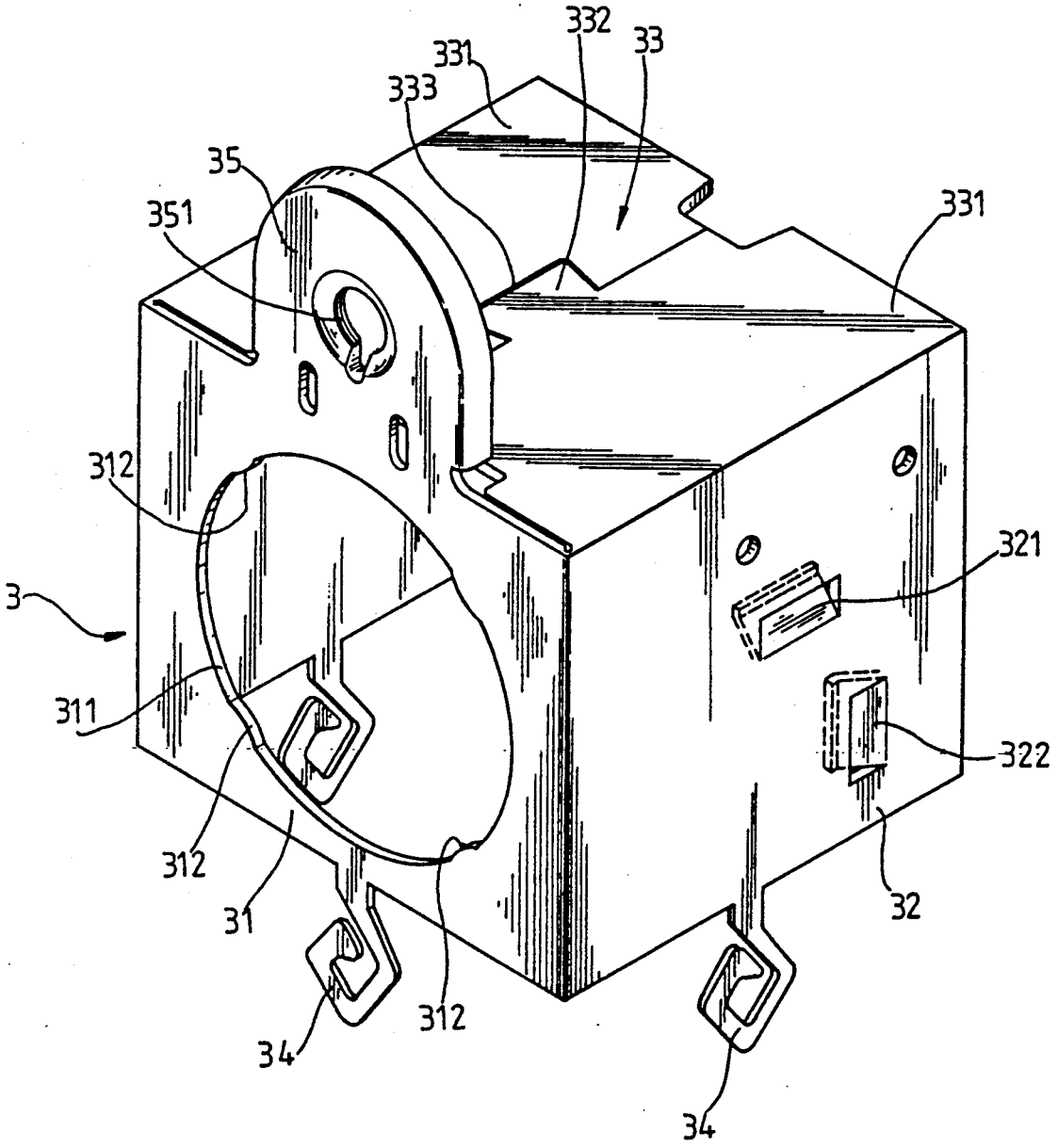
FIG. 11 illustrates another alternate form of the matel casing of the present invention.

As alternate forms of the present invention, the metal ring 2 and the metal casing 3 may be variously embodied. FIG. 8 illustrates another embodiment of metal ring according to the present invention, which includes a substantially Z-shaped ground post 25 disposed at the lower end of the rubber core 1 to follow the rubber core 1 to mount on a mother board. FIG. 9 illustrates still another embodiment of metal ring according to the present invention, in which a cut out 26 is made on the body of the metal ring 2 so that the metal ring 2 can incorporate with the fastening tube (A) of any other type of plug to form an grounded circuit. FIG. 10 illustrates an alternate form of the metal casing 3, in which the front wall 31 includes a unitary fastening plate 35 having a bolt hole 351 thereon for the insertion thereto of a screw means to secure the casing to a computer mainframe, the side walls 32 include a curved and/or resilient ground plate 34 having a diamond-shaped bottom end or a hook-shaped resilient ground plate (34) (shown in FIG. 11) for insertion into a corresponding hole on a mother board so that the receptacle can be firmly mounted on such a mother board.

I claim:

1. A receptacle for electric connectors with a self-locking and electric shielding mechanism, comprising:

a rubber core integrally made of rubber material through a shape molding process and having a top and two opposite sides, a circular slot in said top, two opposite retaining holes in said top at the outer side of said circular slot, two recessed holes and two fastening holes at said opposite sides, said fastening holes each comprising a tapered guide slot extending to said top;

a metal ring having an inner wall surface and a bottom end and comprising a plurality of unitary, elastic clamping members, a semi-circular side hole, a plurality of elastic projections extending from said inner wall surface, two positioning pins bilaterally extending downward from said bottom end, said two opposite positioning pins each having a unitary retainer plate; and a metal casing comprising a front wall, two side walls and a top wall, a hole in said front wall having a plurality of arch-shaped convex portions around the circumference of said hole, said two side walls each comprising an inner wall surface and two clamping members respectively projecting inwardly from said inner wall surface on said metal casing, said top wall being formed of two unitary wing portions extending from said two side walls, said two wing portions being respectively connected together by means of a tongue on one wing portion and a groove on the other wing portion;

so that said positioning pins of said metal ring are respectively inserted in said retaining holes of said rubber core permitting said metal ring to be firmly retained in said circular slot, and said metal casing is externally connected to said rubber core with said clamping members of said casing respectively fastened in said recessed holes, and said fastening holes of said rubber core permit said arch-shaped convex portions of said metal casing to contact said clamping members of said metal ring.

2. A receptacle as claimed in claim 1, wherein said metal casing further comprises:

a resilient ground plate having an arrow-shaped distal end.

3. A receptacle as claimed in claim 1, wherein said metal casing further comprises:

a hook-shaped resilient ground plate.

4. A receptacle as claimed in claim 1 wherein said metal ring further comprises:

a side wall; and a cut out through said side wall of said ring.

5. A receptacle as claimed in claim 1, wherein said metal casing further comprises:

a resilient ground plate having a diamond-shaped bottom end.

6. A receptacle as claimed in claim 1, wherein said metal ring further comprises:

a circular top edge; and a substantially Z-shaped ground post extending downwardly and outwardly from said circular top edge.

7. A receptacle as claimed in claim 6, wherein said metal casing further comprises:

a unitary fastening plate extending from said front wall thereof beyond said top wall thereof; and a bolt hole in said fastening plate.

8. A receptacle as claimed in claim 6, wherein said rubber core further comprises:

recessed slots for receiving therein said clamping members of said metal ring.

9. A receptacle as claimed in claim 6, wherein said metal casing further comprises:

a resilient ground plate having an arrow-shaped distal end.

10. A receptacle as claimed in claim 6, wherein said metal casing further comprises:

a hook-shaped resilient ground plate.

11. A receptacle as claimed in claim 6 wherein said metal ring further comprises:

a side wall; and cut out through said side wall of said ring.

12. A receptacle as claimed in claim 1, wherein said metal casing further comprises:

a unitary fastening plate extending from said front wall thereof beyond said top wall thereof; and a bolt hole in said fastening plate.

13. A receptacle as claimed in claim 12, wherein said rubber core further comprises:

recessed slots for receiving therein said clamping members of said metal ring.

14. A receptacle as claimed in claim 13, wherein said metal casing further comprises:

a resilient ground plate having an arrow-shaped distal end.

15. A receptacle as claimed in claim 14, wherein said metal casing further comprises:

a hook-shaped resilient ground plate.

16. A receptacle as claimed in claim 1, wherein said rubber core further comprises:

recessed slots for receiving therein said clamping members of said metal ring.

17. A receptacle as claimed in claim 16 wherein said metal ring further comprises:

a side wall; and a cut out through said side wall of said ring.

18. A receptacle as claimed in claim 16, wherein said metal casing further comprises:

a resilient ground plate having an arrow-shaped distal end.

19. A receptacle as claimed in claim 18 wherein said metal ring further comprises:

a side wall; and a cut out through said side wall of said ring.

* * * * *